US005305996A

United States Patent [19]

Taniwa et al.

[11] Patent Number: 5,305,996

[45] Date of Patent: Apr. 26, 1994

[54] PAPER HOPPER

[75] Inventors: Tatsuhiro Taniwa; Tetsuya Fujimoto; Toshio Fukushima; Hirohiko Kubo; Wataru Miki, all of Hyogo, Japan

[73] Assignee: Fujitsu Limited, Kanagawa, Japan

[21] Appl. No.: 113,362

[22] Filed: Aug. 30, 1993

Related U.S. Application Data

[63] Continuation of Ser. No. 874,284, Nov. 10, 1992, abandoned.

[30] Foreign Application Priority Data

Nov. 13, 1991 [JP] Japan ..... 3-297108
Mar. 10, 1992 [JP] Japan ..... 4-051418
Apr. 20, 1992 [JP] Japan ..... 4-099630

[51] Int. Cl.[5] ..... B65H 1/12

[52] U.S. Cl. ..... 271/22; 271/126; 271/160; 271/219

[58] Field of Search ..... 271/160, 126, 219, 22, 271/24, 25

[56] References Cited

U.S. PATENT DOCUMENTS 3,831,931 8/1974 Tsukamoto ..... 271/160
4,060,233 11/1977 Stange ..... 271/160
4,524,965 6/1985 Kulpa ..... 271/160 X

FOREIGN PATENT DOCUMENTS 59-43739 7/1984 Japan .
2-43133 4/1990 Japan .
2-62326 5/1990 Japan .

*Primary Examiner*—Richard A. Schacher
*Attorney, Agent, or Firm*—Armstrong, Westerman, Hattori, McLeland & Naughton

[57] ABSTRACT

An inexpensive large-capacity paper hopper capable of energizing a paper feed table with a constant lift force irrespective of the quantity of paper sheets remaining thereon, thereby performing stable paper feeding. To achieve such a paper hopper, a paper hopper, wherein a paper feed table is lifted or lowered being kept in a horizontal condition and paper sheets stacked on the paper feed table are sequentially sent out from the top sheet for feeding, is arranged such that the paper feed table is so suspended by a wire suspending device as to be lifted or lowered in a horizontal condition, and an elastic tensile force of extension coil springs included in a lift force exerting device is so exerted to the paper feed table that the direction in which the restoring displacement of the extension coil springs takes place becomes coincident with the direction of lifting the paper feed table.

13 Claims, 8 Drawing Sheets

PAPER HOPPER

This application is a continuation of application Ser. No. 07/974,284 filed Nov. 10, 1992, now abandoned.

1. BACKGROUND OF THE INVENTION (a) Field of the Invention

The present invention relates to a paper hopper for feeding paper sheets to a device such as an electrophotographic device, and more particularly to a paper hopper in which a paper feed table can be lifted and lowered being kept in a horizontal condition and paper sheets stacked on the paper feed table are sequentially sent out from the top sheet for feeding.

(b) Description of the Prior Art

In recent years, there has been a growing demand for large-capacity paper hoppers for feeding paper sheets to a device such as an electrophotographic device, as the speed of the printing process in printers including electrophotographic devices has been remarkably increased. However, a paper hopper of the cassette type that is installed by inserting in such a device, is limited in capacity by the size of the device to which it is applied, and therefore, it has become very common to employ a paper hopper of the separation type that is installed together with and separately from the device.

There are disclosed prior paper hoppers of the separation type in the following publications.

(1) Japanese Patent Publication Laid-Open No. 60-40340 (1985)

An endless wire rope is provided at each of the opposite sides of the paper feed table. Each endless wire rope is extended in figure-of-eight fashion such that parts of the wire rope form vertical portions parallel to the ascending/descending plane of the paper feed table. The paper feed table is then fixedly attached to and suspended by the vertical portions of each wire rope in a horizontal condition so that the paper feed table can be lifted or lowered being kept in a horizontal condition by synchronously driving the endless wire ropes at the same speed and in the same direction. By means of a driving motor, the endless wire ropes are accordingly driven with the same torque in synchronization with each other, whereby a lift force is exerted to the paper feed table.

(2) Japanese Patent Publication Laid-Open No. 3-36124 (1991)

Each of the opposite sides of the paper feed table is provided with a front lift arm for lifting the front edge of the paper feed table and a rear lift arm for lifting the rear edge of the paper feed table. The front and rear lift arms are coupled to each other by a gear so as to freely pivot on their fulcrums. By allowing the front lift arms disposed at the opposite sides to pivot synchronously and the rear lift arms to pivot synchronously through the gear, the paper feed table can be lifted or lowered being kept in a horizontal condition. An extension coil spring is then provided for exerting an elastic tensile force to one of the front lift arms so that the arm pivots on its fulcrum to lift the paper feed table. Thus, a lift force is exerted to the paper feed table.

SUMMARY OF THE INVENTION

The former case, however, fails in achieving large-capacity paper hoppers produced at low cost because the provision of a driving motor used for energizing the paper feed table with a lift force and a power source for such a driving motor leads to an increase in the production cost.

In the latter case, since the paper feed table is energized with a lift force by exerting the elastic tensile force of the extension coil spring to the front lift arm in order to allow the arm to pivot on its fulcrum, the restoring displacement of the extension coil spring is not proportional to the lifting amount of the paper feed table. In consequence, the paper feed table cannot be energized with a constant lift force irrespective of the quantity of paper sheets remaining on the paper feed table, resulting in a failure in the accomplishment of the stable feeding of paper sheets.

In order to overcome the foregoing problems, the invention aims to provide a large-capacity paper hopper which can be produced at low cost and is capable of energizing the paper feed table with a constant lift force irrespective of the quantity of paper sheets remaining thereat so that paper feeding can be stably performed.

In order to accomplish the above object, there is provided a paper hopper according to the invention, wherein a paper feed table can be lifted and lowered being kept in a horizontal condition and paper sheets stacked on the paper feed table are sequentially sent out from a top sheet for feeding, the paper hopper comprising:

(a) wire suspending means having an endless wire rope at at least each of one pair of opposite sides of the paper feed table, each endless wire rope being extended in figure-of-eight fashion in such a manner that parts of the endless wire rope form vertical portions parallel to an ascending/descending plane of the paper feed table, and fixing the paper feed table to the vertical portions of the extended endless wire ropes in order to suspend it in a horizontal condition so that the paper feed table can be lifted or lowered being kept in a horizontal condition; and (b) lift force exerting means for exerting a lift force to the paper feed table, the exerting means having at least one resilient member for exerting an elastic tensile force to the paper feed table such that the direction of lifting the paper feed table is coincident with the direction in which the restoring displacement of the resilient member takes place.

Accordingly, the wire suspending means enables the paper feed table to be lifted and lowered being kept in a horizontal condition, and the paper feed table is energized with a lift force by exerting the elastic tensile force of the resilient member included in the lift force exerting means to the paper feed table. This arrangement eliminates the necessity of a driving motor used at the time of energizing the paper feed table with a lift force as well as a power source for such a driving motor, and enables the achievement of a large-capacity paper hopper produced at low cost. Further, the paper feed table is energized with a lift force by exerting an elastic tensile force thereto in such a manner that the direction of lifting the paper feed table is coincident with the direction of the restoring displacement of the resilient member, and this allows the restoring displacement of the resilient member to be proportional to the lifting amount of the paper feed table. In consequence, the paper feed table can be energized with a constant lift force irrespective of the quantity of paper sheets remaining at the paper feed table, and paper feeding can be stably performed.

In one preferred embodiment of the invention, the wire suspending means comprises a plurality of pairs of pulleys disposed along a side face of the paper feed table at the respective opposite sides, the pulleys aligned in a vertical direction forming a pair. At the respective sides of the paper feed table, the endless wire rope is wound around those pulleys in figure-of-eight fashion and the resilient member included in the lift force exerting means is provided, so that a lift force can be exerted from both of the sides to the paper feed table. In this case, a common rotary shaft may be provided for at least one pair of pulleys out of those pulleys for coupling them to each other, the pulleys of this pair being disposed oppositely to each other with the paper feed table between, and this rotary shaft may be provided with a clutch which is interposed between the two pulleys and has a predetermined play angle for accommodating the rotations of the pulleys. This arrangement prevents such an unfavourable situation that when loading paper sheets onto the paper feed table, the paper feed table is tilted unstably, interfering the loading operation.

In another preferred form embodying the invention, the wire suspending means comprises a plurality of pairs of pulleys disposed along a side face of the paper feed table at the respective sides, the pulleys aligned in a vertical direction forming a pair, and the endless wire rope is wound around those pulleys in figure-of-eight fashion at the respective sides. A common rotary shaft is also provided for at least one pair of pulleys out of those pulleys for coupling them to each other, the pulleys of this pair being disposed oppositely to each other with the paper feed table between, so that the endless wire ropes at both sides can synchronously move at the same speed in the same direction. In this case, the resilient member of the lift force exerting means is provided at only either of the sides of the paper feed table so that a lift force is exerted to the paper feed table from the one side.

Preferably, the rotary shaft of at least one of the pulleys is provided with a one-way clutch gear having a shock absorber attached thereto.

In the case that the resilient member is so disposed that the restoring displacement of the resilient member takes place in a direction that is inclined downwards with respect to the lifting direction of the paper feed table, one end of a wire rope is coupled to the resilient member at one end thereof which is located on the same line as the direction of the restoring displacement and from which a lift force is exerted to the paper feed table. The other end of the wire rope is first wound around the pulley which is located on the same line as the direction of the restoring displacement above the paper feed table. Then, the wire rope is diverted downwards such that the direction of the restoring displacement is made to be coincident with the lifting direction of the paper feed table and is finally fixed at the paper feed table.

The lift force exerting means may be arranged such that the lift force for energizing the paper feed table is varied in accordance with the size of paper sheets to be stacked on the paper feed table by varying the elastic tensile force of the resilient member exerted to the paper feed table. With this arrangement, a force pressing the top sheet from the underside can be maintained at a predetermined value regardless of the size of paper sheets on the paper feed table, thereby accomplishing the stable feeding of paper sheets.

The preferable construction of the resilient member for the above embodiment wherein the lift force exerted by the lift force exerting means is varied will be explained below. In those arrangements, the resilient member is composed of extension coil springs.

(1) At least two extension coil springs are employed to constitute the resilient member and connected in series. From one end of the extension coil springs connected in series, an elastic tensile force is exerted to the paper feed table whilst the other end is fixed. The connecting point between the two extension coil springs is so arranged as to be fixed or released from the fixation freely. By selectively fixing or releasing this point, the elastic tensile force to be exerted to the paper feed table can be varied.

(2) At least two extension coil springs juxtaposed are employed to constitute the resilient member. One end of one of the juxtaposed extension coil springs is connected to one end of the other spring and from this connecting end, an elastic tensile force is exerted to the paper feed table. The other end of one of the springs is fixed whilst the other end of the other spring is arranged so as to be fixed or released from the fixation freely. By selectively fixing or releasing the above end, the elastic tensile force to be exerted to the paper feed table can be varied.

(3) At least two extension coil springs juxtaposed are employed to constitute the resilient member. One end of one of the juxtaposed extension coil springs is connected to one end of the other spring and from the connecting end, an elastic tensile force is exerted to the paper feed table. The other ends of those springs are respectively arranged so as to be fixed or released from the fixation freely. By selectively fixing or releasing those ends, the elastic tensile force to be exerted to the paper feed table can be varied.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a view of a paper hopper of the invention in use, the hopper being of the separation type installed together with an electrophotographic device;

FIG. 2 is a perspective view of the entire structure of the paper hopper of the invention;

FIG. 3 is a schematic diagram showing the mechanism of the paper hopper of the invention;

FIG. 4 is a partially enlarged diagram of a lift force exerting device shown in FIG. 2;

FIG. 5 is an exploded perspective view of a rotary shaft;

FIG. 6 is a diagram illustrating a play angle; and

FIGS. 7 and 8 are front views each showing a modified example of the lift force exerting device.

DESCRIPTION OF THE PREFERRED EMBODIMENT

Figure 1:
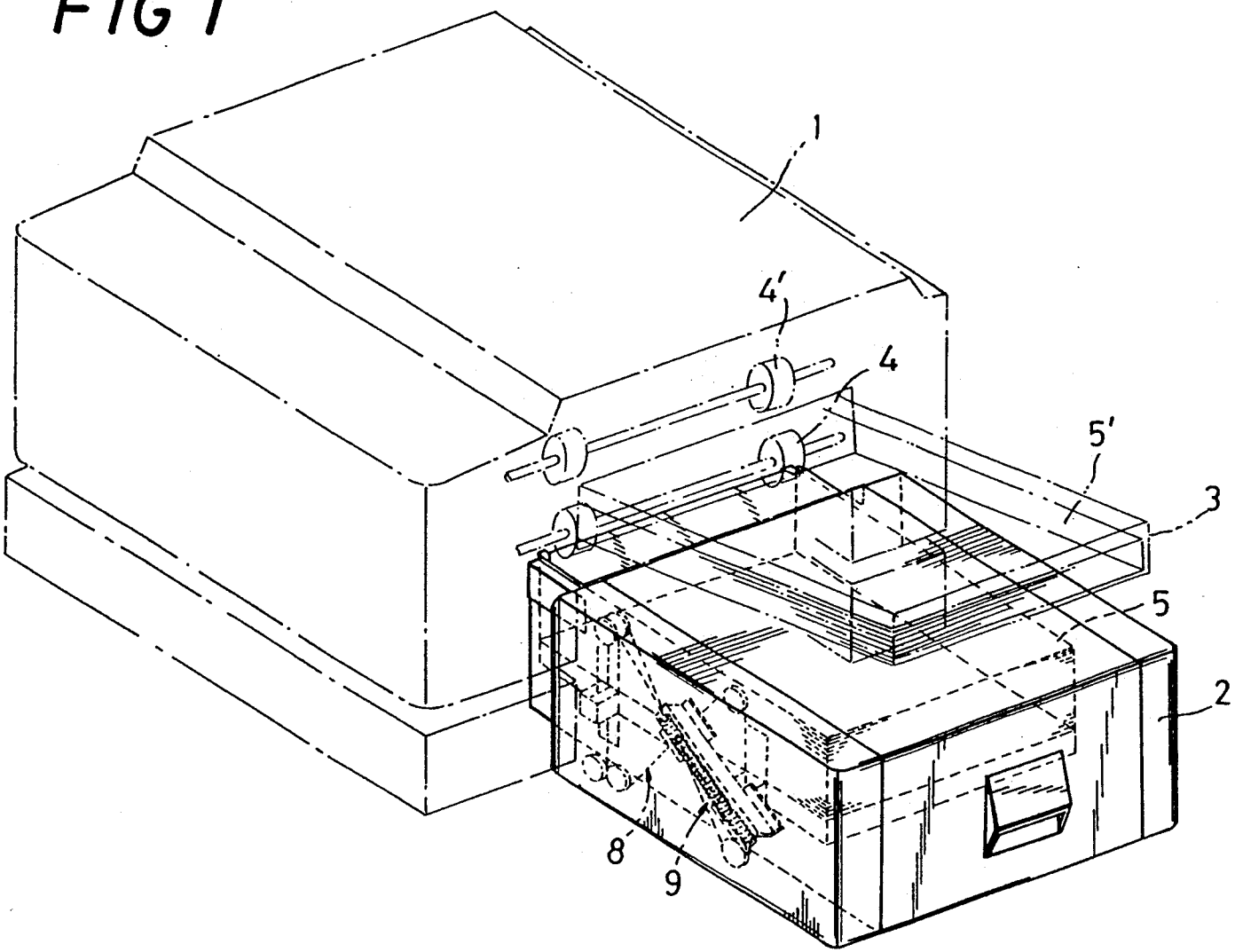
FIGS. 1 through 8 are for illustrating a concrete embodiment of a paper hopper according to the invention.

Referring now to the drawings, a concrete embodiment of a paper hopper according to the invention will be hereinafter described.

In FIG. 1, there is provided a paper hopper of the separation type 2 to which the invention is applied, the paper hopper 2 being separated from an electrophotographic device 1 such as facsimiles and printers. When used, this paper hopper of the separation type 2 is installed together with the electrophotographic device 1 as shown in FIG. 1. Reference numeral 3 denotes a paper hopper of the cassette type which is installed by inserting into the electrophotographic device 1. Reference numerals 4, 4' denote paper delivery rollers for delivering paper sheets 5, 5' stacked in the paper hoppers 2, 3 sequentially from the top sheets into the electrophotographic device 1.

Figure 2:
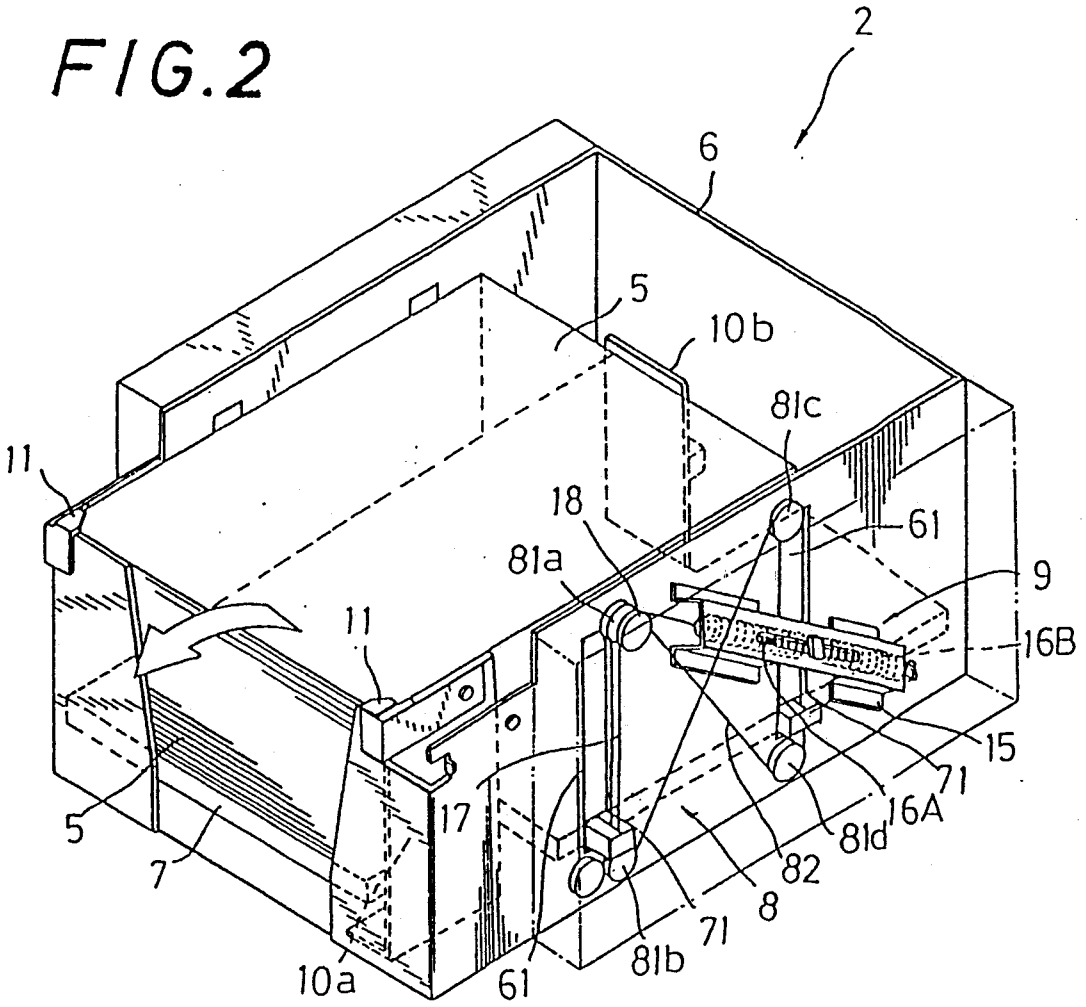

The paper hopper of the separation type 2 (hereinafter referred to as "paper hopper") to which the invention is applied is provided with a paper feed table 7 housed in a main body 6 of the paper hopper 2 as shown in FIG. 2. On the paper feed table 7 are stacked the paper sheets 5. At the right side and left side of the paper feed table 7 in relation to the delivery direction of the paper sheets 5 shown in FIG. 2 (i.e., on the right and left side faces of the main body 6), there is provided a wire suspending device 8 for allowing the paper feed table 7 to be lifted or lowered in a horizontal condition and a lift force exerting device 9 for exerting a lift force to the paper feed table 7. Although FIG. 2 only shows the components of the wire suspending device 8 and the lift force exerting device 9 at one side, it should be noted that the same components of the wire suspending device 8 and the lift force exerting device 9 are provided symmetrically at the other side which is not shown in the drawing. The main body 6 is provided with guide plates 10*a*, 10*b* on the bottom face thereof, those guide plates 10*a*, 10*b* being freely movable in compliance with the size of the paper sheets 5 in its width-wise direction and length-wise direction respectively so that the paper sheets 5 of different sizes (A4-size, B4-size) can be stacked on the paper feed table 7. One paper separation claw 11 is provided on the upper part of the guide plate 10*a* which is movable in the width-wise direction of the paper sheets 5 and another claw 11 at the upper corner of the main body 6, the upper corner confronting the guide plate 10*a* in the width-wise direction. The top sheet of the paper sheets 5 stacked on the paper feed table 7 is pressed from the underside with a lift force exerted by the lift force exerting device 9 so that the top sheet comes in uniform contact with the paper separation claws 11. The side walls of the main body 6 on the right and left hands of the paper delivery direction are each provided with a pair of guide holes 61, and those guide holes 61 are elongated in a vertical direction and aligned along the paper delivery direction. At the respective sides of the paper feed table 7, there are provided projections 71 each of which projects through the corresponding guide hole 61 with play. Again, FIG. 2 only shows the pair of guide holes 61 and the pair of projections 71 disposed at one side.

Figure 3:
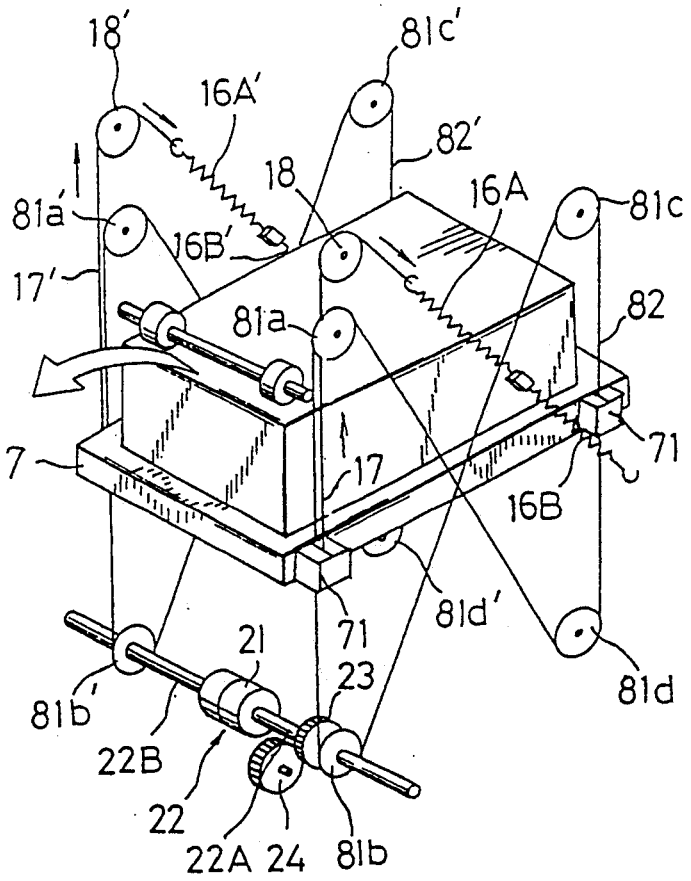

Now, the wire suspending device 8, the lift force exerting device 9 and other members will be described in that order while making reference to the schematic diagrams of FIGS. 2 and 3.

(1) Wire suspending device 8

When viewing the sides of the paper feed table 7 on the right and left hands of the paper delivery direction, there are provided two pairs of pulleys 81*a* through 81*d* on one side and another two pairs of pulleys 81*a*' through 81*d*' on the other side. Specifically, vertically aligned two pulleys form one pair and those pairs are fixedly attached to the respective side walls of the main body 6 along the paper delivery direction. An endless wire rope 82 is wound around the two pairs of pulleys 81*a* through 81*d* and another endless wire rope 82' is wound around the two pairs of pulleys 81*a*' through 81*d*' in figure-of-eight fashion in such a manner that parts of the respective wire ropes 82, 82' form vertical portions parallel to the ascending/descending plane of the paper feed table 7. By means of the vertical portions of those extended endless wire ropes 82, 82', the paper feed table 7 is fixed and suspended in a horizontal condition through the respective projections 71. With the above-described arrangement, the paper feed table 7 can be lifted or lowered being kept in a horizontal condition.

(2) Lift force exerting device 9

The sides of the paper feed table 7 on the right and left hands of the paper delivery direction are each provided with a guide sleeve 15. Each of the guide sleeves 15 is fixed to the side wall of the main body 6 in such a manner that the guide sleeve 15 is inclined towards the pulley 81*a* (81*a*') from the side close to the bottom face of the main body 6, the pulley 81*a* (81*a*') being located at an upper position on the side toward which the paper sheets 5 are sent out. The guide sleeve 15 accommodates two extension coil springs 16A, 16B (16A', 16B') connected in series. The lower end of those serially connected two extension coil springs 16A, 16B (16A', 16B') is fixed to the main body 6 whilst the upper end thereof is coupled to one end of a wire rope 17 (17') so that an elastic tensile force is exerted to the paper feed table 7 from this upper end. The other end of the wire rope 17 (17') is wound around a pulley 18 (18') which is coaxial with the pulley 81*a* (81*a*') disposed at the upper position on the side toward which the paper sheets 5 are sent out, and then hung down to be fixed to the projection 71 (71) of the paper feed table 7. Therefore, the direction of the restoring displacement of the serially connected two extension coil springs 16A, 16B (16A', 16B') shown in FIG. 3 is diverted by means of the pulley 18 (18') to be coincident with the lifting direction of the paper feed table 7. An elastic tensile force is accordingly exerted to the paper feed table 7 by means of those extension coil springs 16A, 16B, 16A' and 16B' whereby the paper feed table 7 is energized with a lift force.

Figure 4:
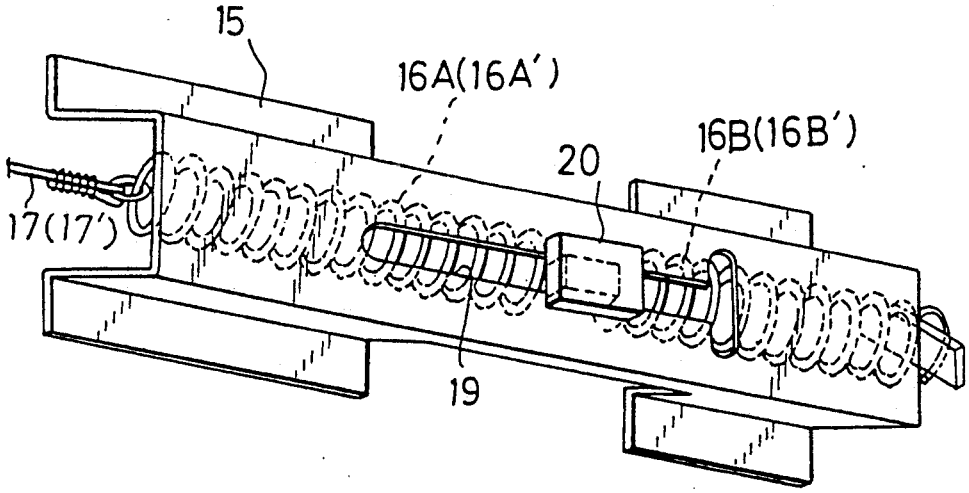

Referring to FIG. 4, a selector lever 20 is provided at a connecting point between the extension coil springs 16A, 16B (16A', 16B') and the selector lever 20 is inserted with play into an elongated hole 19 which is defined at the guide sleeve 15, extending along the longitudinal direction thereof. The elongated hole 19 has such a configuration that when the selector lever 20 is moved along the elongated hole 19 to the lowermost position thereof, the selector lever 20 can be fixed at the lowermost position by rotating it through 90 degrees.

With the above arrangement, when the paper sheets 5 of A4-size are loaded on the paper feed table 7, the selector lever 20 is fixed at the lowermost position of the elongated hole 19 and the elastic tensile force of the extension coil spring 16A (16A') only is exerted to the paper feed table 7, thereby energizing the paper feed table 7 with a lift force. On the other hand, when the paper sheets 5 of B4-size are loaded onto the paper feed table 7, the selector lever 20 is rotated through 90 degrees at the lowermost position of the elongated hole 19 to be released therefrom and the elastic tensile forces of both of the extension coil springs 16A, 16B (16A' and 16B') are exerted to the paper feed table 7, thereby energizing the paper feed table 7 with a lift force. Accordingly, the lift force exerted to the paper feed table 7 is altered in accordance with the size of the paper sheets 5 to be stacked on the paper feed table 7 with the result that the force pressing the top sheet from the underside against the paper separation claws 11 is maintained at a predetermined value and stable paper separation operation can be achieved.

(3) Other members

Figure 5:
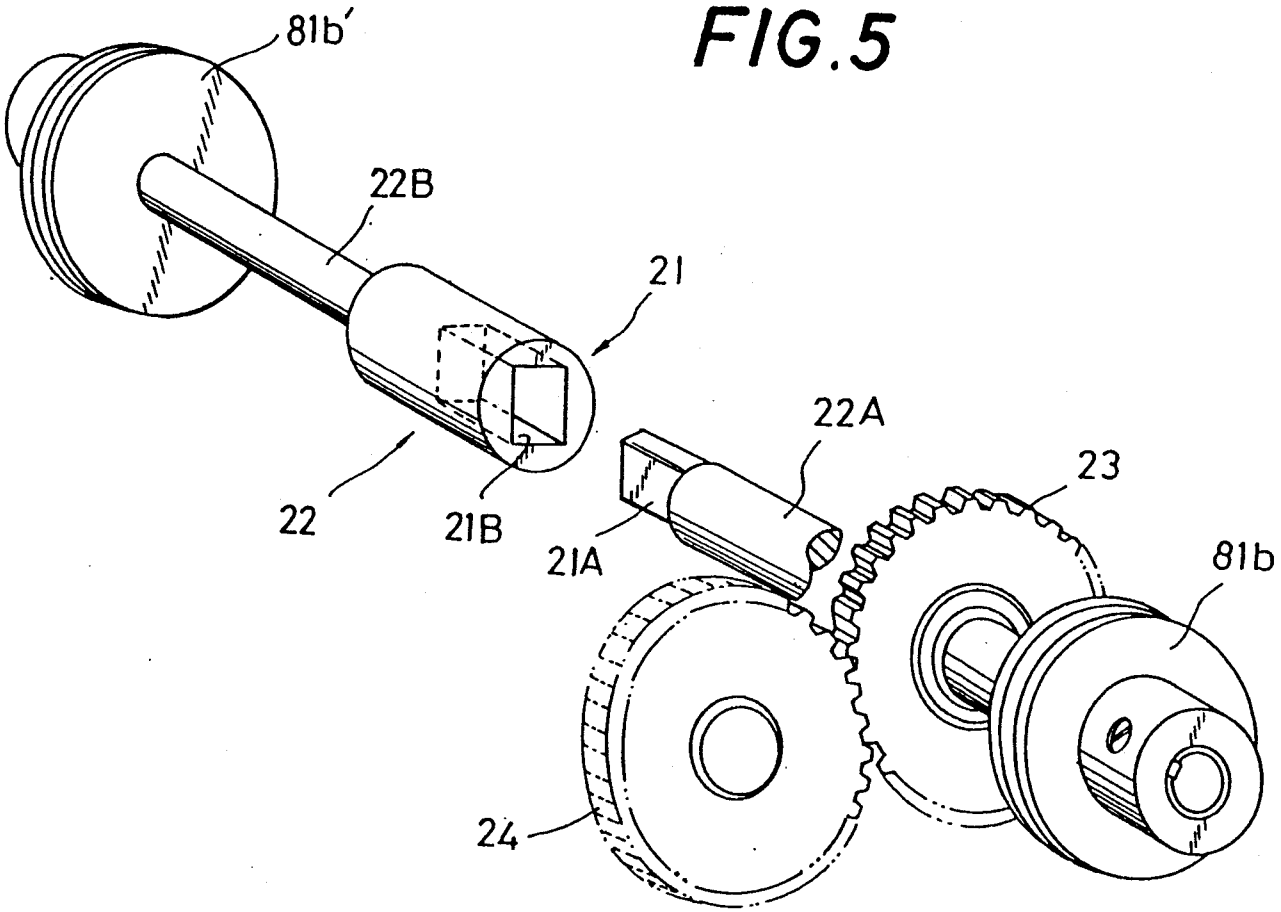
Figure 6:
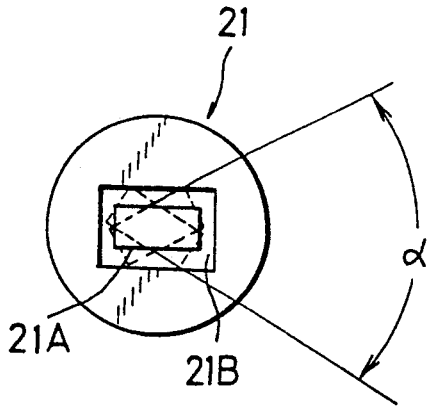

There is provided a common rotary shaft 22 for coupling the pulleys **81*b* and 81*b'* to each other, those pulleys 81*b*, 81*b'* being disposed oppositely to each other with the paper feed table 7 between at the lower positions on the side toward which the paper sheets 5 are sent out. The common rotary shaft 22 has a clutch 21 interposed between the pulleys 81*b* and 81*b'* as shown in FIG. 5 and is rotatably supported by the main body 6 at the bottom side thereof. The clutch 21 is made up of, as shown in FIG. 5, a male part consisting of a parallelepiped 21A formed at one end of one rotary shaft portion 22A and a female part consisting of a square hole 21B defined at one end of another rotary shaft portion 22B. The size of the square hole 21B is larger than that of the parallelepiped 21A so that the former can be fitted in the latter with play. The torques of the pulleys 81*b* and 81*b'* are transmitted to each other, utilizing a predetermined play angle $\alpha$ as shown in FIG. 6**.

The provision of the clutch 21 having the predetermined play angle $\alpha$ has the following effect: when the operator manually loads the paper sheets 5 on the paper feed table 7, even if a pressing force added to the paper feed table 7 is uneven between the right and left of the paper feed table 7, causing an ununiformed force onto the endless wire ropes 82, 82', the paper feed table 7 will be inclined only to such an extent that the predetermined play angle $\alpha$ of the clutch 21 is used up. After the predetermined play angle $\alpha$ of the clutch 21 has been used up, the rotary shaft portions 22A, 22B are connected in a straight manner so that the pulleys **81*b* and 81*b'* attached to the ends of the rotary shaft portions 22A and 22B respectively (i.e., attached to both ends of the rotary shaft 22) rotate synchronously and the endless wire ropes 82, 82' run at the same speed in the same direction. Therefore, the inclination of the paper feed table 7 is no longer increased. Consequently, there is no likelihood that when loading paper sheets onto the paper feed table 7, the paper feed table 7 is inclined unstably, interfering with the paper loading operation. Further, even if a force imbalance is caused between the right and left of the paper feed table 7 (e.g., between the endless wire ropes 82 and 82'), such an imbalance can be restrained within the range of the predetermined play angle $\alpha$ since the lift force exerting device 9 exerts a lift force to the paper feed table 7, pressing the top sheet of the paper sheets 5 stacked on the paper feed table 7 against the paper separation claws 11 from the underside. As a result, the top sheet can be brought into uniform contact with the paper separation claws 11**.

Viewing the right end of FIG. 5, a one-way clutch gear 23, which is coaxial with the pulley **81*b*, is provided at a part of the rotary shaft 22 connected to the pulley 81*b*, namely, at the rotary shaft portion 22A. The one-way clutch gear 23 is provided with a damper 24 that is a shock-absorber in which powder friction is utilized and has a gear in mesh with the one-way clutch gear 23. When the paper feed table 7 is forced down at the time of loading the paper sheets 5 for example, the one-way clutch gear 23 is rotated in an unlocked condition so that the gear of the damper 24 does not rotate. On the other hand, when the paper feed table 7 is lifted, the one-way clutch gear 23 is rotated in a locked condition, thereby rotating the gear of the damper 24**.

With the above-described one-way clutch gear 23 and damper 24, the paper feed table 7 can be easily lowered when the paper feed table 7 is forced down since the damper 24 is not operative at that time. When the paper feed table 7 is lifted on the other hand, the damper 24 is operative and therefore, the paper feed table 7 is unlikely to rise abruptly. This avoids such an unfavourable situation that when the pressing force added to the paper feed table 7 is released after forcing the paper feed table 7 down without the paper sheets 5 stacked thereon, the paper feed table 7 abruptly rises, giving an excessively great impact to the paper separation claws 11 and other members.

Referring now to the drawings, modified examples of the lift force exerting device 9 will be described. It should be noted that those members indicated by the same reference numerals in the foregoing embodiment and the following examples have substantially similar functions and repetition of the same description will be omitted.

Figure 7:
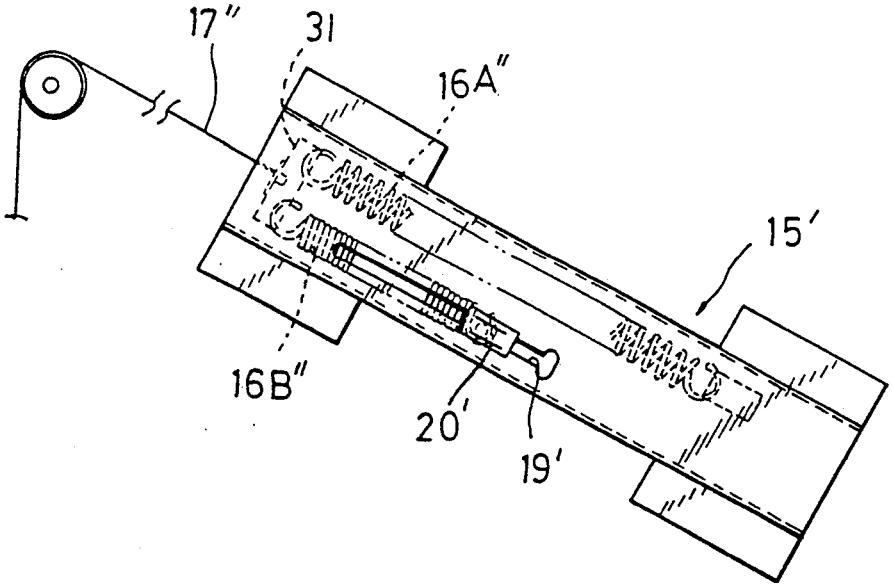

FIRST MODIFIED EXAMPLE (see FIG. 7)

Housed in a guide sleeve 15' are two juxtaposed extension coil springs 16A'', 16B'' having different elastic tensile forces. The lower end of the extension coil spring 16A'' is secured to the main body 6 of the paper hopper 2, whilst the lower end of the extension coil spring 16B'' is provided with a selector lever 20' which is inserted into an elongated hole 19' with play. The upper ends of the extension coil springs 16A'' and 16B'' are coupled to each other by means of a coupling member 31 and coupled further to one end of a wire rope 17'' through the coupling member 31. From this side, an elastic tensile force is exerted to the paper feed table 7. Similarly to the elongated hole 19 in the foregoing embodiment, the elongated hole 19' has such a configuration that when the selector lever 20' is moved to the lowermost position of the elongated hole 19', the selector lever 20' can be fixed at the lowermost position by a rotation through 90 degrees. With the above arrangement, when the paper sheets 5 of B4-size are loaded on the paper feed table 7, the selector lever 20' is fixed at the lowermost position of the elongated hole 19' and the elastic tensile forces of the extension coil springs 16A'' and 16B'' are exerted to the paper feed table 7. When the paper sheets 5 of A-4 size are loaded on the paper feed table 7, the selector lever 20' is rotated through 90 degrees so as to be released from the lowermost position, thereby exerting the elastic tensile force of the extension coil spring 16A'' only to the paper feed table 7 (this condition is shown in FIG. 7). This arrangement allows the lift force exerted to the paper feed table 7 to be varied according to the size of the paper sheets 5 stacked on the paper feed table 7.

Figure 8:
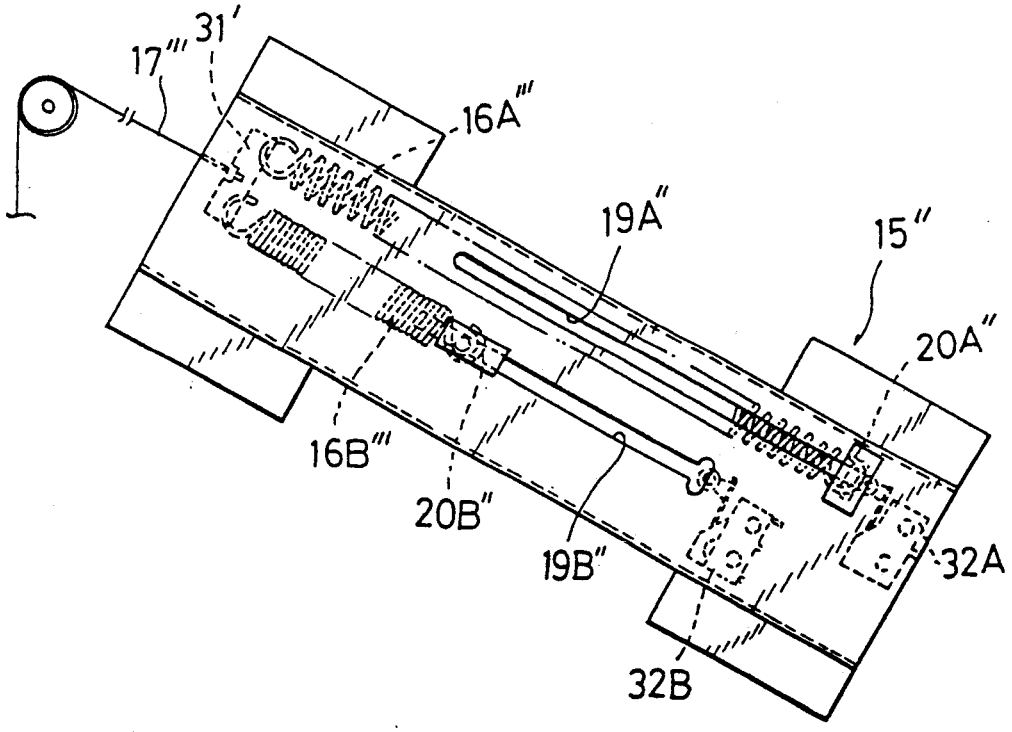

SECOND MODIFIED EXAMPLE (see FIG. 8)

Housed in a guide sleeve 15'' are two juxtaposed extension coil springs 16A''' and 16B'''. The lower ends of the extension coil springs 16A''' and 16B''' are provided with selector levers 20A'' and 20B'' which are inserted into corresponding elongated holes 19A'' and 19B'' with play. The upper ends of the extension coil springs 16A''' and 16B''' are coupled to each other by means of a coupling member 31' like the first modified example and coupled further to one end of a wire rope 17''' through the coupling member 31'. Similarly, the elongated holes 19A'' and 19B'' have such a configuration that when the selector levers 20A'' and 20B'' are moved to the lowermost positions of the elongated holes 19A'' and 19B'' respectively, the selector levers 20A'' and 20B'' can be fixed at the lowermost positions by rotating them through 90 degrees. There are further provided switches 32A and 32B that correspond to the extension coil springs 16A''' and 16B''' respectively and are turned ON by fixing the selector levers 20A'' and 20B'' through their 90-degree rotations. With the above arrangement, when the paper sheets 5 of B4-size are loaded on the paper feed table 7, the selector lever 20A'' is fixed at the lowermost position of the elongated hole 19A'' and only the elastic tensile force of the extension coil spring 16A''' is exerted to the paper feed table 7 (this condition is as shown in FIG. 8). When the paper sheets 5 of A-4 size are loaded on the paper feed table 7 on the other hand, the selector lever 20B'' is fixed at the lowermost position of the elongated hole 19B'', thereby exerting only the elastic tensile force of the extension coil spring 16B''' to the paper feed table 7. The switching states of the switches 32A and 32B that are turned ON by the fixation of the selector levers 20A'' and 20B'' as mentioned above are transmitted to a printer (not shown) where it is identified by the switching states of the switches 32A and 32B whether the paper sheets 5 to be stacked on the paper feed table 7 are of A4-size or B4-size.

Although A-4 size and B-4 size are specified for the sizes of the paper sheets 5 stacked on the paper feed table 7 in the above embodiment, other sizes may be employed in combination. It is also possible to employ one size, or alternatively the combination of three sizes or more. It should be noted that in the case other paper sizes than those of the above embodiment are adopted, the number of extension coil springs, spring constant, the alignment of the springs etc. need to be adequately altered.

Although the clutch 21 having the predetermined play angle $\alpha$ in the above embodiment is arranged such that the male part consisting of the parallelepiped 21A is fitted in the female part consisting of the square hole 21B with play, the clutch 21 could be arranged to have specified engagement grooves formed at the contact faces of two disk plates, thereby providing the play angle $\alpha$.

Further, the two extension coil springs 16A and 16B (16A' and 16B') are connected in series in the above embodiment, but it is also possible to use one extension coil spring consisting of dividual parts.

Further, the above embodiment adopts such an arrangement that there are disposed the two pairs of vertically aligned pulleys **81*a*, 81*b* and 81*c*, 81*d* at one side of the paper feed table 7 and the two pairs of pulleys 81*a'*, 81*b'* and 81*c'*, 81*d'*** at the other side, the sides being located on the right and left hands of the paper delivery direction. However, it is also possible to arrange three or more pairs of pulleys at each side.

Although in the above embodiment, there is provided the common rotary shaft 22 provided with the clutch 21 having the predetermined play angle $\alpha$, and the opposite pulleys **81*b* and 81*b'* are coupled to each other by the common rotary shaft 22 with the clutch 21 interposed therebetween, the common rotary shaft 22 without the clutch 21 may be employed. In the embodiment of the invention, the lift force exerting device 9 is provided at each side of the paper feed table 7 and a lift force is exerted to the paper feed table 7 from each side. In the case that the clutch 21 is not interposed, the endless wire ropes 82, 82' move perfectly synchronously at the same speed in the same direction so that the lift force exerting device 9 may be provided at only one side of the paper feed table 7 and a lift force may be exerted to the paper feed table 7 from the one side through the common rotary shaft 22. Furthermore, in the case the paper feed table 7 is energized with a lift force exerted from both sides thereof by means of the lift force exerting devices 9 like the above embodiment, the object of the invention is not hampered even if the above-described common rotary shaft 22** is not employed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper hopper wherein a paper feed table is lifted and lowered being kept in a horizontal condition and paper sheets stacked on the paper feed table are sequentially sent out from a top sheet for feeding, the paper hopper comprising:

(a) wire suspending means having an endless wire rope at at least each of one pair of opposite sides of the paper feed table, each endless wire rope being extended in figure-of-eight fashion in such a manner that parts of the endless wire rope form vertical portions parallel to an ascending/descending plane of the paper feed table; and fixing the paper feed table to the vertical portions of the extended endless wire ropes in order to suspend it in a horizontal condition so that the paper feed table can be lifted or lowered being kept in a horizontal condition; and (b) lift force exerting means for exerting a lift force to the paper feed table, the exerting means having at least one resilient member for exerting an elastic tensile force to the paper feed table such that the direction of lifting the paper feed table is coincident with the direction in which the restoring displacement of the resilient member takes place.

2. The paper hopper as claimed in claim 1, wherein said wire suspending means includes a plurality of pairs of pulleys disposed along a side face of the paper feed table at said respective opposite sides, the pulleys aligned in a vertical direction forming a pair; the pulleys are wound by the endless wire rope in figure-of-eight fashion at said respective sides; and the resilient member included in the lift force exerting means is provided at said respective sides in order to exert a lift force to the paper feed table therefrom.

3. The paper hopper as claimed in claim 2, wherein a common rotary shaft is provided for at least one pair of pulleys out of said pulleys for coupling them to each other, the pulleys to be coupled being disposed oppositely to each other with the paper feed table between;

and the rotary shaft is provided with a clutch which is interposed between the pair of pulleys and has a predetermined play angle for accommodating the rotations of the pulleys.

4. The paper hopper as claimed in claim 1, wherein said wire suspending means includes a plurality of pairs of pulleys disposed along a side face of the paper feed table at said respective sides, the pulleys aligned in a vertical direction forming a pair; the pulleys are wound by the endless wire rope in figure-of-eight fashion at said respective sides; and a common rotary shaft is provided for at least one pair of pulleys out of said pulleys for coupling them to each other, the pulleys to be coupled being disposed oppositely to each other with the paper feed table between, so that the endless wire ropes at said sides can synchronously move at the same speed in the same direction.

5. The paper hopper as claimed in any of claims 2 through 4, wherein at least one of said pulleys has a rotary shaft provided with a one-way clutch gear having a shock absorber attached thereto.

6. The paper hopper as claimed in any of claims 2 through 4, wherein said resilient member is so disposed that the restoring displacement of the resilient member takes place in a direction that is inclined downwards with respect to the lifting direction of the paper feed table; one end of a wire rope is coupled to the resilient member at one end thereof which is located on the same line as the direction of the restoring displacement and from which a lift force is exerted to the paper feed table; and the other end of the wire rope is wound around the pulley located on the same line as the direction of the restoring displacement above the paper feed table, and then diverted downwards to be fixed at the paper feed table such that the direction of the restoring displacement is made to be coincident with the lifting direction of the paper feed table.

7. The paper hopper as claimed in any of claims 1 through 4, wherein said lift force exerting means is arranged such that the lift force for energizing the paper feed table is varied in accordance with the size of the paper sheets to be stacked on the paper feed table by varying the elastic tensile force of the resilient member exerted to the paper feed table.

8. The paper hopper as claimed in any of claims 1 through 4, wherein said resilient member is composed of extension coil springs.

9. The paper hopper as claimed in claim 8, wherein the lift force exerted by the lift force exerting means is varied in such a way that the resilient member is made up of at least two extension coil springs connected in series; the elastic tensile force is exerted to the paper feed table from one end of the extension coil springs connected in series whilst the other end of the extension coil springs is fixed; a connecting point between the two extension coil springs is so arranged as to be fixed or released from the fixation freely; and the elastic tensile force to be exerted to the paper feed table is varied by selectively fixing or releasing the connecting point.

10. The paper hopper as claimed in claim 8, wherein the lift force exerted by the lift force exerting means is varied in such a way that the resilient member is made up of at least two extension coil springs juxtaposed; one end of one of the juxtaposed extension coil springs is connected to one end of the other spring and from this connecting end, the elastic tensile force is exerted to the paper feed table; the other end of one of the springs is fixed whilst the other end of the other spring is arranged so as to be fixed or released from the fixation freely; and the elastic tensile force to be exerted to the paper feed table is varied by selectively fixing or releasing the other end.

11. The paper hopper as claimed in claim 8, wherein the lift force exerted by the lift force exerting means is varied in such a way that the resilient member is made up of at least two extension coil springs juxtaposed; one end of one of the juxtaposed extension coil springs is connected to one end of the other spring and from the connecting end, the elastic tensile force is exerted to the paper feed table; the other ends of those springs are arranged so as to be fixed or released from the fixation freely; and the elastic tensile force to be exerted to the paper feed table is varied by selectively fixing or releasing those ends.

12. The paper hopper as claimed in claim 11, further comprising switches which are respectively operated when the other end of the corresponding extension coil spring is fixed so that the size of the paper sheets stacked on the paper feed table is identified by the switching states of those switches.

13. The paper hopper as claimed in any of claims 1 through 4, wherein the paper hopper is of the separation type which is installed together with but separately from an electrophotographic device to which the paper sheets are fed.

* * * * *